US010763017B2

(12) United States Patent
Kinoshita

(10) Patent No.: US 10,763,017 B2
(45) Date of Patent: Sep. 1, 2020

(54) METAL PLATE RESISTOR AND METHOD FOR MANUFACTURING SAME

(71) Applicant: Panasonic Intellectual Property Management Co., Ltd., Osaka (JP)

(72) Inventor: Yasuharu Kinoshita, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/495,387

(22) PCT Filed: May 8, 2018

(86) PCT No.: PCT/JP2018/017683
§ 371 (c)(1),
(2) Date: Sep. 19, 2019

(87) PCT Pub. No.: WO2018/216455
PCT Pub. Date: Nov. 29, 2018

(65) Prior Publication Data

US 2020/0075200 A1 Mar. 5, 2020

(30) Foreign Application Priority Data

May 23, 2017 (JP) ..... 2017-101363
Jan. 19, 2018 (JP) ..... 2018-006836

(51) Int. Cl.
*H01C 1/144* (2006.01)
*H01C 7/00* (2006.01)
(Continued)

(52) U.S. Cl.
CPC ..... *H01C 1/144* (2013.01); *H01C 7/003* (2013.01); *H01C 17/006* (2013.01); *H01C 17/281* (2013.01)

(58) Field of Classification Search
CPC ..... H01C 1/144; H01C 7/003; H01C 17/006; H01C 17/281
See application file for complete search history.

(56) References Cited

U.S. PATENT DOCUMENTS 7,129,814 B2 * 10/2006 Tsukada ..... H01C 1/148 338/309
8,058,968 B2 * 11/2011 Hirano ..... H01C 17/245 338/309
(Continued)

FOREIGN PATENT DOCUMENTS

JP 10-335114 12/1998
JP 2004-022658 1/2004
(Continued)

OTHER PUBLICATIONS

International Search Report of PCT application No. PCT/JP2018/017683 dated Jul. 24, 2018.

*Primary Examiner* — Kyung S Lee
(74) *Attorney, Agent, or Firm* — McDermott Will & Emery LLP

(57) ABSTRACT

An object of the present disclosure is to provide a metal plate resistor that is capable of reducing a resistance value and a TCR. A metal plate resistor according to the present disclosure includes: a resistor body that includes a metal plate having an upper surface and a lower surface that are spaced apart from each other in a thickness direction; a pair of electrodes that include a metal having a low electrical resistivity and a high TCR in comparison with this resistor body, the pair of electrodes being formed in both ends of the lower surface of the resistor body; and an internal electrode that is formed on the upper surface of the resistor body. The internal electrode includes a metal having a low electrical resistivity in comparison with the resistor body.

8 Claims, 14 Drawing Sheets

(51) Int. Cl.
*H01C 17/00* (2006.01)
*H01C 17/28* (2006.01)

(56) References Cited

U.S. PATENT DOCUMENTS

| | | | | |
|---|---|---|---|---|
| 8,686,828 | B2 * | 4/2014 | Smith | H01C 1/142 338/254 |
| 9,959,957 | B2 * | 5/2018 | Tsuda | H01C 7/003 |
| 10,418,157 | B2 * | 9/2019 | Smith | H01C 17/00 |
| 2004/0252009 | A1 | 12/2004 | Tsukada | |
| 2005/0035844 | A1 * | 2/2005 | Tsukada | H01C 1/148 338/309 |
| 2005/0200451 | A1 | 9/2005 | Tsukada | |
| 2006/0097340 | A1 * | 5/2006 | Tsukda | H01C 1/144 257/516 |
| 2006/0273423 | A1 | 12/2006 | Tsukada | |
| 2007/0018782 | A1 * | 1/2007 | Tsukada | H01C 1/148 338/309 |
| 2007/0132545 | A1 * | 6/2007 | Tsukada | H01C 7/003 338/309 |
| 2016/0343479 | A1 * | 11/2016 | Itou | H01C 1/084 |

FOREIGN PATENT DOCUMENTS

| | | |
|---|---|---|
| JP | 2004-311747 | 11/2004 |
| JP | 2004-327907 | 11/2004 |
| JP | 2009-218317 | 9/2009 |
| JP | 2017-183692 | 10/2017 |

* cited by examiner

METAL PLATE RESISTOR AND METHOD FOR MANUFACTURING SAME

FIELD OF THE INVENTION

The present disclosure relates to a metal plate resistor that is used to detect a current amount by measuring a voltage between a pair of electrodes in information communication equipment represented by smartphones or tablets.

DESCRIPTION OF THE RELATED ART

A conventional metal plate resistor includes resistor body 1 that includes a metal plate including CuNi, a pair of electrodes 2*a*, 2*b* that are formed on a lower surface of resistor body 1 and include Cu, plating layers 3 that are used to improve soldering, first protection film 4 that is formed between the pair of electrodes 2*a*, 2*b* on the lower surface of resistor body 1, and second protection film 5 that is formed on an upper surface of resistor body 1, as illustrated in FIG. 16.

As citation list information relating to the invention of the present application, PTL 1 is known, for example.

CITATION LIST

Patent Literature

PTL 1: Unexamined Japanese Patent Publication No. 2004-311747

SUMMARY OF THE INVENTION

In the conventional configuration described above, a current only flows through the pair of electrodes 2*a*, 2*b* and a portion near a lower surface between the pair of electrodes 2*a*, 2*b* of resistor body 1, and therefore a resistance value fails to be reduced. Further, a ratio increases at which a thermal coefficient of resistance (TCR) of the pair of electrodes 2*a*, 2*b* that include Cu having a large TCR of $4300\times10^{6}$/° C. contributes to a TCR of an entirety of the metal plate resistor. Thus, there is a problem in which the TCR increases as the resistance value is reduced.

The present disclosure has been made to solve the conventional problem described above, and it is an object of the present disclosure to provide a metal plate resistor that is capable of reducing a resistance value and a TCR.

In order to solve the problem described above, the invention of the present disclosure includes a pair of electrodes that include a metal having a low electrical resistivity and a high TCR in comparison with a resistor body, and an internal electrode that is formed on an upper surface of the resistor body. The internal electrode includes a metal having a low electrical resistivity in comparison with the resistor body.

In a metal plate resistor according to the present disclosure, due to the internal electrode, a resistance value of a path to an upper side (a side of the internal electrode) is reduced. Therefore, a larger current flows to the upper side. This enables the resistance value to be reduced. In addition, in the metal plate resistor according to the present disclosure, when temperature increases, a resistance value of the pair of electrodes increases. Therefore, a current that flows to the upper side of the resistor body further increases. This causes a measured resistance value to be reduced, and therefore an effect of a reduction in a TCR is exhibited.

DETAILED DESCRIPTION OF THE PREFERRED EMBODIMENTS

Figure 1:
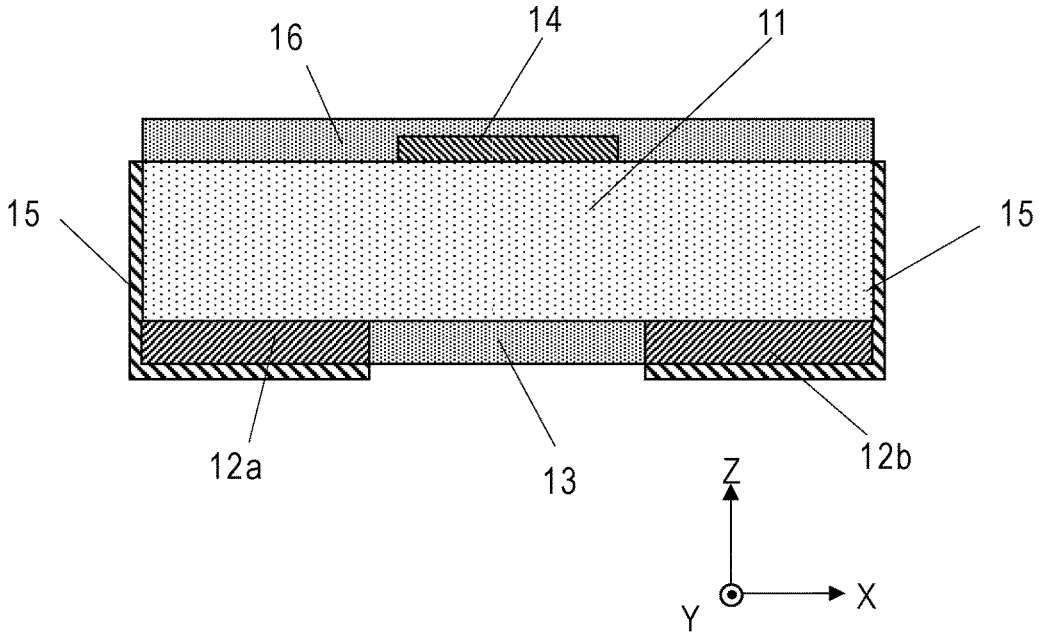
FIG. 1 is a sectional view of a metal plate resistor according to an exemplary embodiment of the present disclosure.

FIG. 1 is a sectional view of a metal plate resistor according to one exemplary embodiment of the present disclosure.

A metal plate resistor according to one exemplary embodiment includes resistor body 11, a pair of electrodes (electrode 12*a* and electrode 12*b*), first protection film 13, internal electrode 14, and plating layers 15, as illustrated in FIG. 1. Resistor body 11 includes a metal plate that has an upper surface and a lower surface that are spaced apart from each other in a thickness direction. The pair of electrodes 12*a*, 12*b* are formed on both sides of the lower surface of resistor body 11. First protection film 13 covers resistor body 11 between the pair of electrodes 12*a*, 12*b*. Internal electrode 14 is formed on the upper surface of resistor body 11. Plating layers 15 are formed on end surfaces of resistor body 11 and lower surfaces of the pair of electrodes 12*a*, 12*b*. Here, the end surfaces refer to surfaces with a vector along an X-axis direction as a normal line in resistor body 11 illustrated in FIG. 1.

In addition, the pair of electrodes 12*a*, 12*b* include a metal that has a low electrical resistivity (a low specific electrical resistance) and a high TCR in comparison with resistor body 11. Internal electrode 14 includes a metal that has a low electrical resistivity in comparison with resistor body 11.

In a configuration of the metal plate resistor described above, resistor body 11 includes a metal that has a relatively high electrical resistivity and a relatively low TCR, for example, a metal including nichrome, copper nickel, manganin, or the like.

Resistor body 11 described above includes a metal plate that has an upper surface and a lower surface that are spaced apart from each other in a thickness direction. In a case where a resistance value is adjusted, a slit that does not pierce resistor body 11 is formed on a side of the lower surface of resistor body 11. A large current flows on a side of a lower surface between the pair of electrodes 12*a*, 12*b* of resistor body 11. Therefore, a rate of an increase in a resistance value due to formation of the slit can be increased. Thus, the resistance value can be finely adjusted.

In addition, the pair of electrodes 12*a*, 12*b* are provided in both ends of the lower surface of resistor body 11, and include a metal, such as coper or silver, that has a low electrical resistivity (a low specific electrical resistance) and a high TCR in comparison with resistor body 11. The pair of electrodes 12*a*, 12*b* described above include a thick-film material or plating.

Further, first protection film 13 is provided between the pair of electrodes 12*a*, 12*b* so as to cover resistor body 11, and includes a thick-film material including epoxy resin or the like.

Furthermore, internal electrode 14 includes a metal, such as copper or silver, that has a low electrical resistivity in comparison with resistor body 11. It is preferable that a metal included in internal electrode 14 be identical to a metal included in the pair of electrodes 12*a*, 12*b*.

In addition, internal electrode 14 described above is provided in a middle part of a longitudinal direction (a direction in which the pair of electrodes 12*a*, 12*b* face each other (an X-direction)) on the upper surface of resistor body 11. Internal electrode 14 is formed according to a method such as printing, plating, or embedding using a clad. Further, a center part between the pair of electrodes 12*a*, 12*b* that face each other in the longitudinal direction (the X-direction) overlaps a center part of internal electrode 14 in a top view.

Furthermore, a length in the longitudinal direction of internal electrode 14 has been set to be shorter than an interval in the longitudinal direction between the pair of electrodes 12*a*, 12*b* in a top view in such a way that the pair of electrodes 12*a*, 12*b* do not overlap internal electrode 14 in the top view. In addition, an upper surface of internal electrode 14 and an upper surface of resistor body 11 that is exposed from internal electrode 14 are coated with second protection film 16 including epoxy resin. Second protection film 16 may include epoxy resin and a resin substrate.

Plating layers 15 are integrally formed on the end surfaces of resistor body 11 and the lower surfaces of the pair of electrodes 12*a*, 12*b*. Plating layers 15 described above include nickel plating and tin plating, and are provided in order to improve soldering.

Resistor body 11 may include alloy or a metal multilayer film.

Figure 2:
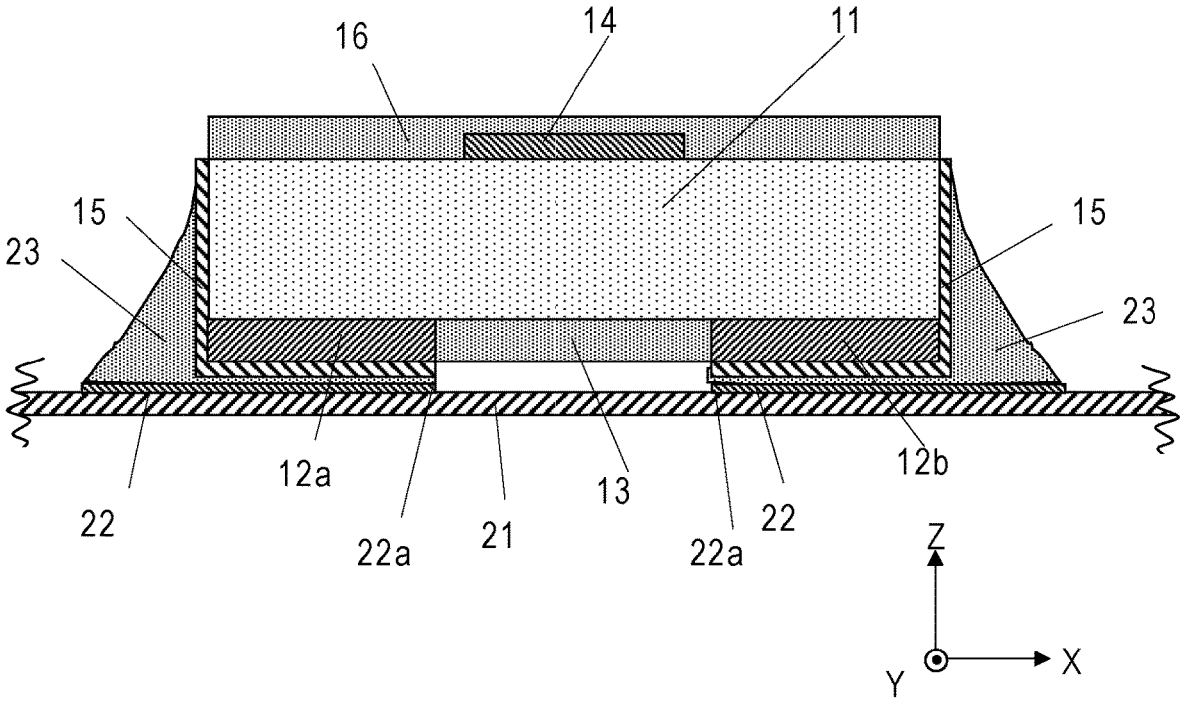
FIG. 2 is a sectional view illustrating a state where the same metal plate resistor has been mounted.

Here, FIG. 2 illustrates a state where a metal plate resistor according to one exemplary embodiment of the present disclosure is mounted in mounting substrate 21.

Plating layers 15 are connected to lands 22 of mounting substrate 21 via mounting solders 23. In addition, lands 22 are located under the lower surfaces of the pair of electrodes 12*a*, 12*b*. A current flows from lands 22 via mounting solders 23, plating layers 15 and the pair of electrodes 12*a*, 12*b* to resistor body 11. A voltage is measured in portions 22*a* that face each other in the longitudinal direction (the X-direction) of lands 22. A current value is detected by using a measured voltage value and the resistance value.

A method for manufacturing a metal plate resistor according to one exemplary embodiment of the present disclosure is described below with reference to the drawings.

In order to improve productivity, a description is provided in a state where the metal plate resistor in the description above of FIGS. 1 and 2 has been turned upside-down.

(First Manufacturing Method)

A method for manufacturing a metal plate resistor according to the present disclosure (a first manufacturing method) is described with reference to FIGS. 3A to 5D.

Figure 3A:
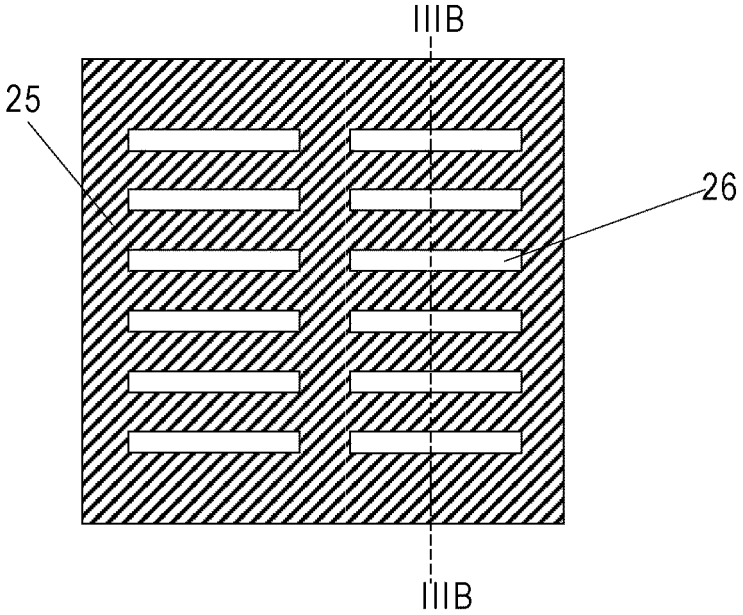
FIG. 3A is a top view of a prepared sheet resistor body in a first manufacturing method.
Figure 3B:
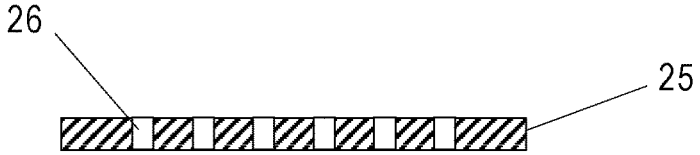
FIG. 3B is a sectional view taken along line III B-III B of the sheet resistor body of FIG. 3A.

First, as illustrated in FIGS. 3A and 3B, sheet resistor body 25 is prepared that has been obtained by configuring a metal including CuMnNi alloy or the like in a plate shape. A plurality of cutouts 26 having a belt shape are provided in sheet resistor body 25 described above so as to be parallel to each other. Cutouts 26 are formed by etching.

Sheet resistor body 25 has one surface and another surface that are spaced apart from each other in the thickness direction. The one surface and the other surface face each other.

Here, FIG. 3A is a top view of sheet resistor body 25 that has been prepared. FIG. 3B is a sectional view taken along line III B-III B of sheet resistor body 25 of FIG. 3A.

Figure 3C:
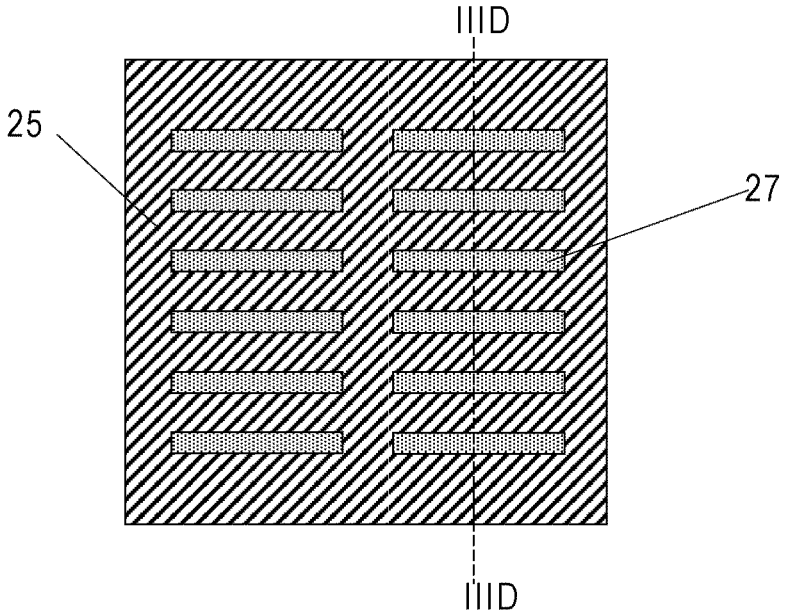
FIG. 3C is a top view of a sheet resistor body in which a protection member has been formed in the first manufacturing method.
Figure 3D:
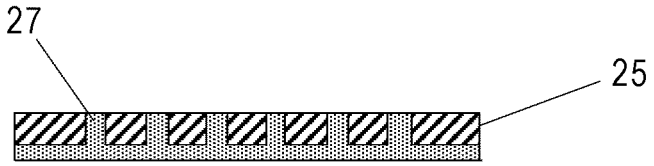
FIG. 3D is a sectional view taken along line III D-III D of the sheet resistor body of FIG. 3C.

Next, as illustrated in FIGS. 3C and 3D, protection member 27 is simultaneously formed on one surface (a lower surface) of sheet resistor body 25 and inside cutouts 26. Protection member 27 is a film including epoxy resin, and a member that increases fluidity by vacuum hot pressing is used. Protection member 27 is formed on the lower surface of sheet resistor body 25, and an inside of each of cutouts 26 is also filled with protection member 27. Then, protection member 27 is hardened.

In protection member 27 described above, a portion on the lower surface of sheet resistor body 25 serves as second protection film 16 of a metal plate resistor in the form of an individual piece, and a third protection member (hereinafter not illustrated) on side surfaces of the metal plate resistor. Second protection film 16 and the third protection film are integrally formed.

Here, FIG. 3C is a top view of sheet resistor body 25 in which protection member 27 has been formed. FIG. 3D is a sectional view taken along line III D-III D of FIG. 3C.

Figure 4A:
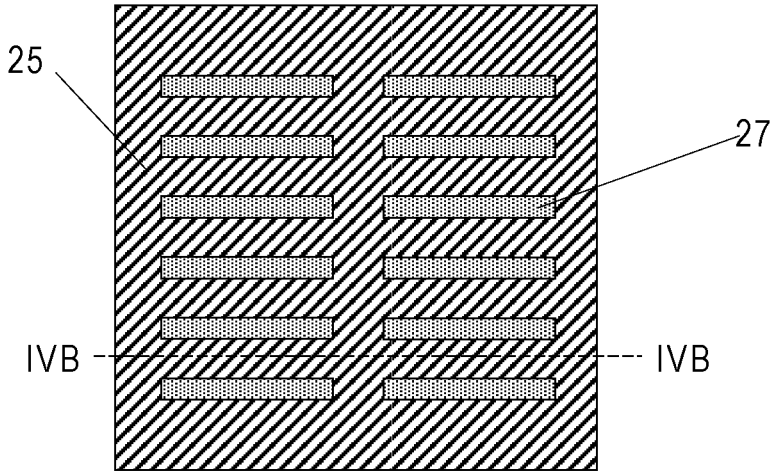
FIG. 4A is a top view of a sheet resistor body in which holes have been formed in predetermined portions of the protection member by using a laser in the first manufacturing method.
Figure 4B:
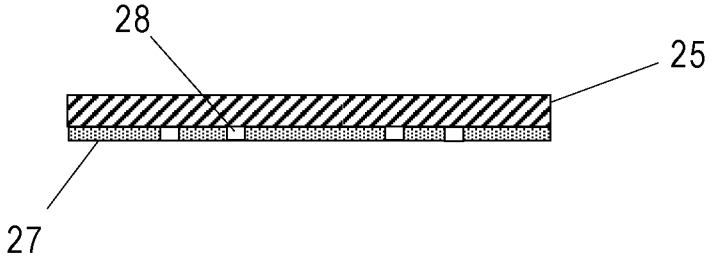
FIG. 4B is a sectional view taken along line IV B-IV B of the sheet resistor body of FIG. 4A.

Next, as illustrated in FIGS. 4A and 4B, holes 28 are formed by using a laser in predetermined portions of protection member 27 that has been formed on the lower surface of sheet resistor body 25. Holes 28 are formed in portions where cutouts 26 have not been formed, namely, in portions between cutout 26 and cutout 26.

Here, FIG. 4A is a top view of sheet resistor body 25 in which holes 28 have been formed by using a laser in predetermined portions of protection member 27. FIG. 4B is a sectional view taken along line IV B-IV B of sheet resistor body 25 of FIG. 4A.

Figure 4C:
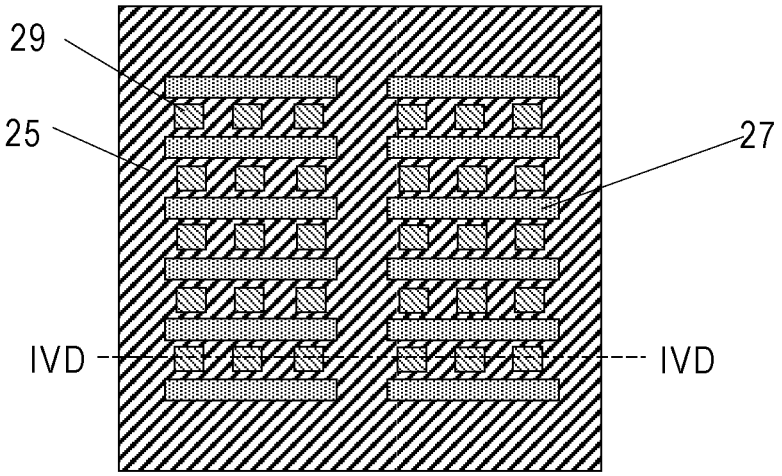
FIG. 4C is a top view of a sheet resistor body at a time when electrode parts have been formed in predetermined portions of an upper surface of the sheet resistor body and internal electrode parts have been formed inside the holes on a lower surface of the sheet resistor body in the first manufacturing method.
Figure 4D:
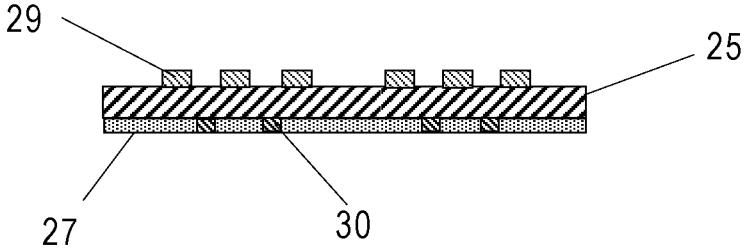
FIG. 4D is a sectional view taken along line IV D-IV D of the sheet resistor body of FIG. 4C.

Next, as illustrated in FIGS. 4C and 4D, electrode parts 29 are formed in predetermined portions on another surface (an upper surface) of sheet resistor body 25, and internal electrode parts 30 are formed inside holes 28 on the lower surface of sheet resistor body 25.

At this time, another resist is stuck on the upper surface of sheet resistor body 25, and the upper surface of sheet resistor body 25 is plated. At this time, the other resist described above is patterned with island shapes in portions between cutouts 26 (filled with protection member 27) of sheet resistor body 25. Then, Cu plating is performed, and the other resist is removed. As a result, a plurality of electrode parts 29 including Cu plating are formed at equal intervals in portions between adjacent cutouts 26.

In addition, simultaneously, a plurality of internal electrode parts 30 including Cu plating are also formed inside holes 28 on the lower surface of sheet resistor body 25. In a metal plate resistor in the form of an individual piece, electrode parts 29 serve as a pair of electrodes 12*a*, 12*b*, and internal electrode part 30 serves as internal electrode 14.

Before the plurality of electrode parts 29 are formed by Cu plating, an inside of each of cutouts 26 is filled with protection member 27, and therefore plating solution does not enter the inside of each of cutouts 26. By doing this, even when a width of each of the plurality of electrode parts 29 increases, excess plating is not formed in the plurality of electrode parts 29.

Here, FIG. 4C is a top view of sheet resistor body 25 at a time when electrode parts 29 have been formed in predetermined portions on the upper surface of sheet resistor body 25 and internal electrode parts 30 have been formed inside holes 28 on the lower surface of sheet resistor body 25. FIG. 4D is a sectional view taken along line IV D-IV D of sheet resistor body 25 of FIG. 4C.

Figure 5A:
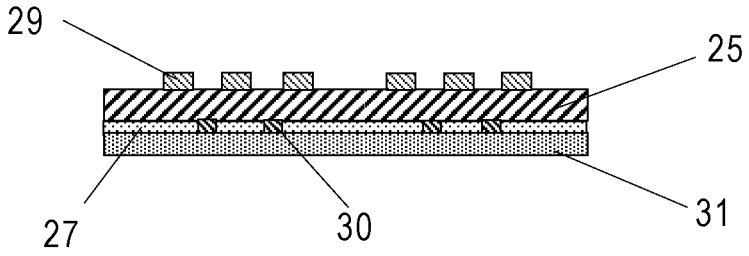
FIG. 5A is a sectional view of a sheet resistor body at a time when a resin substrate has been stuck by pressing on lower surfaces of the protection member and the internal electrode parts in the first manufacturing method.

Next, as illustrated in FIG. 5A, under the lower surface of sheet resistor body 25, resin substrate 31 is stuck by pressing on lower surfaces of protection member 27 and internal electrode parts 30. Resin substrate 31 is a substrate that includes epoxy resin and glass and that has a high strength, and resin substrate 31 includes the same material as a material of mounting substrate 21. Resin substrate 31 allows easy handing in processes that follow.

Thereafter, a slit may be formed as needed, and a resistance value may be adjusted.

Figure 5B:
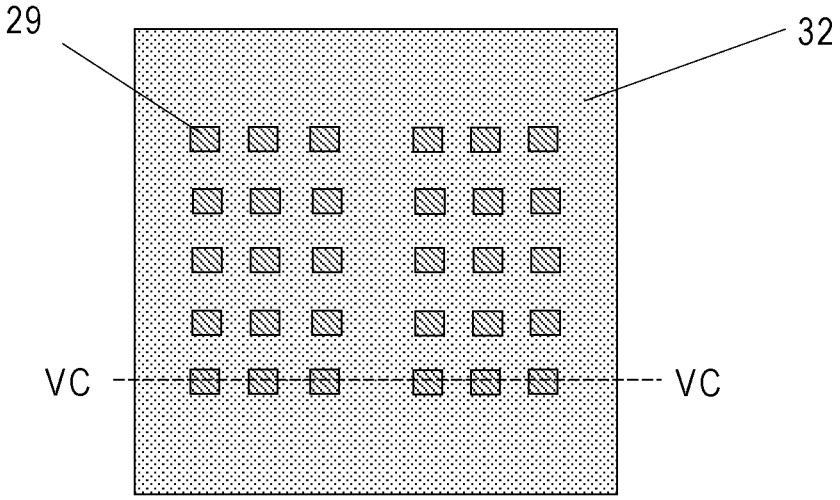
FIG. 5B is a top view of a sheet resistor body in a case where a protection film has been formed among a plurality of electrode parts in the first manufacturing method.
Figure 5C:
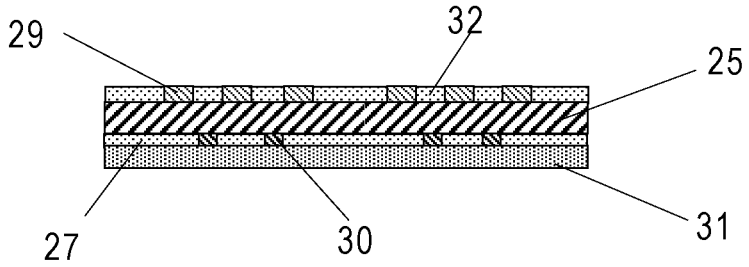
FIG. 5C is a sectional view taken along line V C-V C of the sheet resistor body of FIG. 5B.

Next, as illustrated in FIGS. 5B and 5C, protection film 32 is formed among the plurality of electrode parts 29. Protection film 32 described above includes epoxy resin, and is formed so as to cover a space among the plurality of electrode parts 29 and upper surfaces of the plurality of electrode parts 29. After protection film 32 is hardened, protection film 32 is polished until the plurality of electrode parts 29 are exposed. In a metal pate resistor in the form of an individual piece, protection film 32 serves as first protection film 13.

Here, FIG. 5A is a sectional view of a sheet resistor body at a time when resin substrate 31 has been stuck by pressing on the lower surfaces of protection member 27 and internal electrode parts 30. FIG. 5B is a top view of sheet resistor body 25 in a case where protection film 32 has been formed among the plurality of electrode parts 29. FIG. 5C is a sectional view taken along line V C-V C of sheet resistor body 25 of FIG. 5B.

Next, middle parts of cutouts 26 and middle parts of the plurality of electrode parts 29 are cut, and division is performed so as to form individual pieces.

Figure 5D:
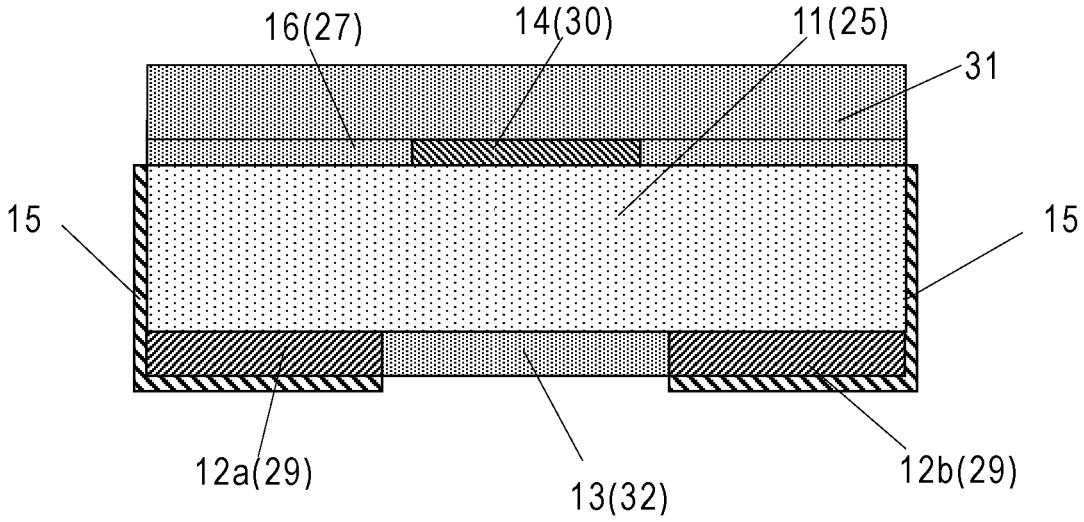
FIG. 5D is a sectional view of a metal plate resistor in the form of an individual piece.

Finally, Ni plating and Sn plating is performed from upper surfaces of a pair of electrodes 12*a*, 12*b* (electrode parts 29)

to end surfaces of resistor body 11 of each of metal plate resistors obtained by division into individual pieces, plating layers 15 are formed, and a metal plate resistor in the form of an individual piece, as illustrated in FIG. 5D, is obtained.

For a simple description, FIGS. 3A to 5D illustrate a portion where 12 cutouts 26, and metal plate resistors in the form of an individual piece in 5 columns and 4 rows have been formed in a sheet shape.

Resin substrate 31 is formed on upper surfaces of second protection film 16 (protection member 27) and internal electrode 14 (internal electrode part 30), as illustrated in FIG. 5D. By doing this, resistor body 11 can be suppressed from being deformed due to heat generation or the like of resistor body 11.

As described above, in a metal plate resistor according to one exemplary embodiment of the present disclosure, internal electrode 14 is formed on an upper surface of resistor body 11, and internal electrode 14 includes a metal, the electrical resistivity of the metal is lower than the electrical resistivity of resistor body 11. Therefore, a resistance value on a path to an upper side (a side of internal electrode 14) is reduced. This causes a larger current to flow to the upper side (the side of internal electrode 14) in resistor body 11. Thus, an effect of a reduction in the resistance value can be exhibited.

Further, when temperature increases, a resistance value of the pair of electrodes 12*a*, 12*b* increases, and therefore a current that flows to the upper side of resistor body 11 further increases. By doing this, a measured resistance value is reduced, and this enables a TCR to be reduced.

(Characteristics of Metal Plate Resistor)

Characteristics of a metal plate resistor according to the present disclosure are described below.

Figure 6:
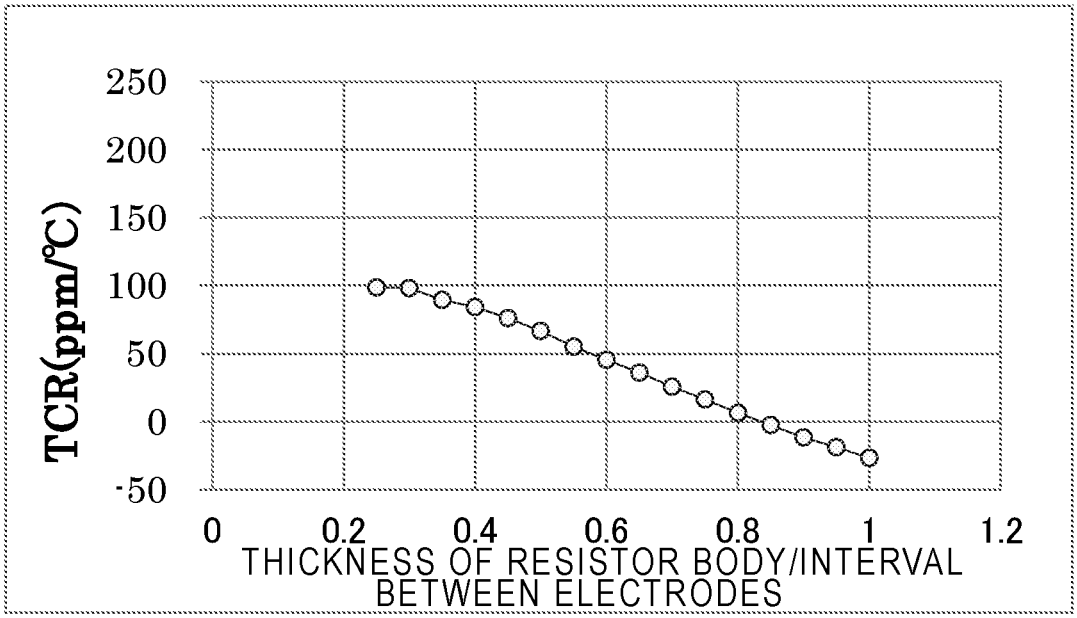
FIG. 6 is a diagram illustrating a relationship between a thickness of a resistor body with respect to an interval between a pair of electrodes and a TCR in a metal plate resistor according to the present disclosure.

FIG. 6 is a diagram illustrating a relationship between a thickness of resistor body 11 with respect to a length in a longitudinal direction of an interval between a pair of electrodes 12*a*, 12*b* and a TCR.

As is evident from FIG. 6, when the thickness of resistor body 11 becomes 0.4 times or more the length of the interval between the pair of electrodes 12*a*, 12*b*, the TCR becomes less than 100 ppm/° C. This is because, when the thickness of resistor body 11 increases, a current that flows along the thickness direction further increases, and the resistance value further decreases. Note that an upper limit value is specified in consideration of a request from a user, productivity, or the like, but the upper limit value is generally 100 ppm/° C. in metal plate resistors.

Accordingly, it is preferable that the thickness of resistor body 11 be set to be 0.4 times or more the length in the longitudinal direction of the interval between the pair of electrodes 12*a*, 12*b*.

Figure 7:
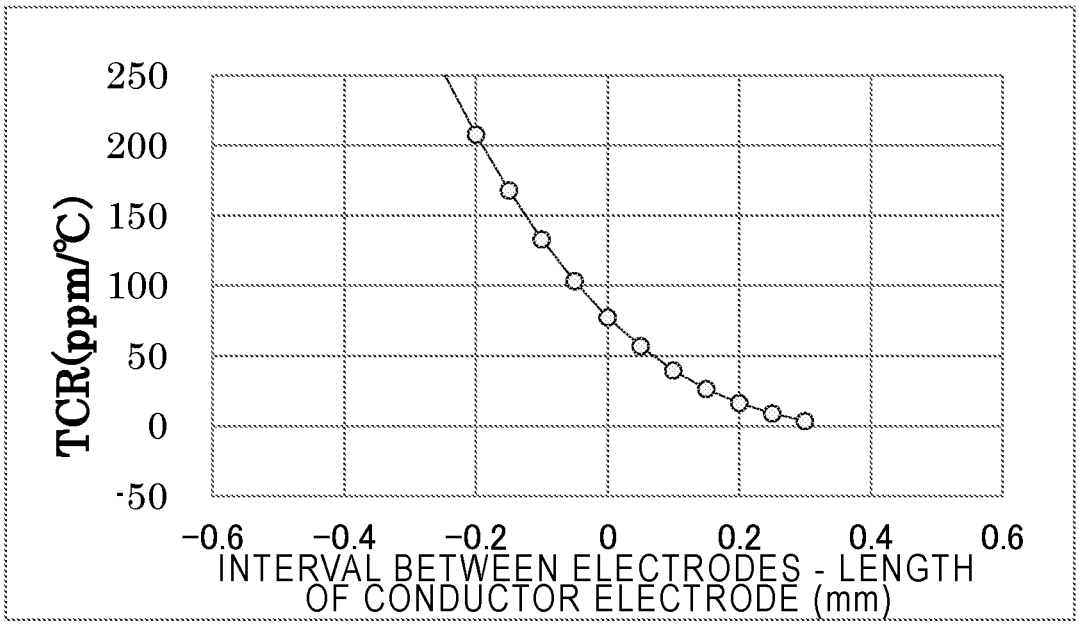
FIG. 7 is a diagram illustrating a relationship between a difference between an interval between a pair of electrodes and a length of an internal electrode and a TCR in the same metal plate resistor.

FIG. 7 is a diagram illustrating a relationship between a difference between a length of an interval between a pair of electrodes 12*a*, 12*b* and a length of internal electrode 14 in the longitudinal direction and a TCR.

As is evident from FIG. 7, in a case where the length of internal electrode 14 becomes a length that is less than or equal to the interval between the pair of electrodes 12*a*, 12*b*, namely, in a case where internal electrode 14 does not overlap the pair of electrodes 12*a*, 12*b* in a top view, the TCR becomes less than 100 ppm/° C.

As a reason for this, when a distance between the pair of electrodes 12*a*, 12*b* and internal electrode 14 increases in a top view, a current that flows from the pair of electrodes 12*a*, 12*b* to internal electrode 14 increases. Therefore, a current that flows along the thickness direction further increases, and the resistance value further decreases, as described above. Note that a lower limit value is determined according to a specified resistance value.

(Variation of Metal Plate Resistor)

Figure 8:
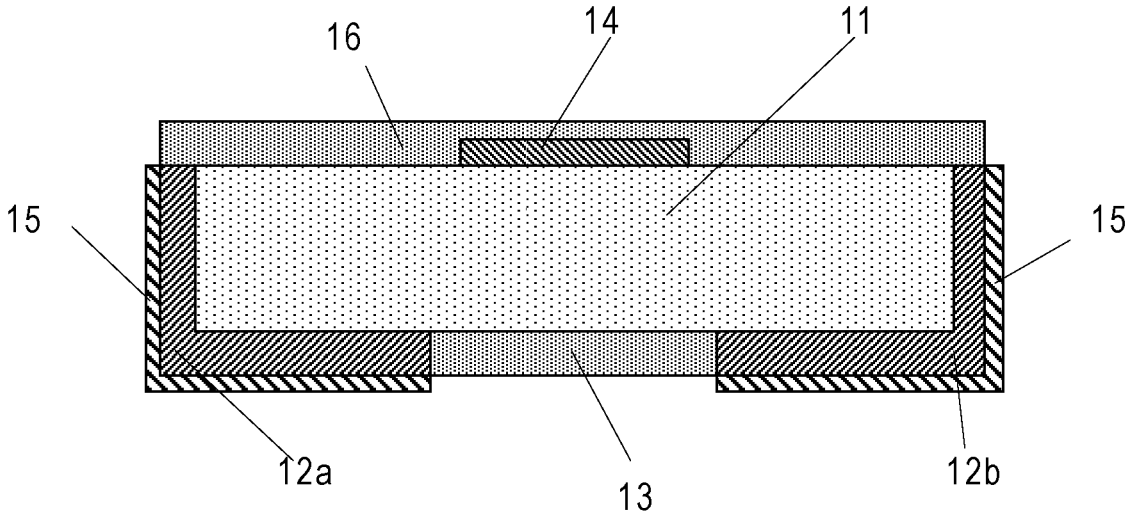
FIG. 8 is a sectional view illustrating a variation of a metal plate resistor according to the present disclosure.

As a variation of the metal plate resistor, the pair of electrodes 12*a*, 12*b* may be integrally formed from the lower surface of resistor body 11 to the end surfaces, as illustrated in FIG. 8. This enables a larger current to flow to an upper side (a side of internal electrode 14) in resistor body 11. Thus, the resistance value can be easily reduced.

(Second Manufacturing Method)

A method for manufacturing a metal plate resistor according to one exemplary embodiment may be formed according to the method described below. A method for manufacturing a metal plate resistor according to the present disclosure (a second manufacturing method) is described with reference to FIGS. 9A to 12B.

Figure 9A:
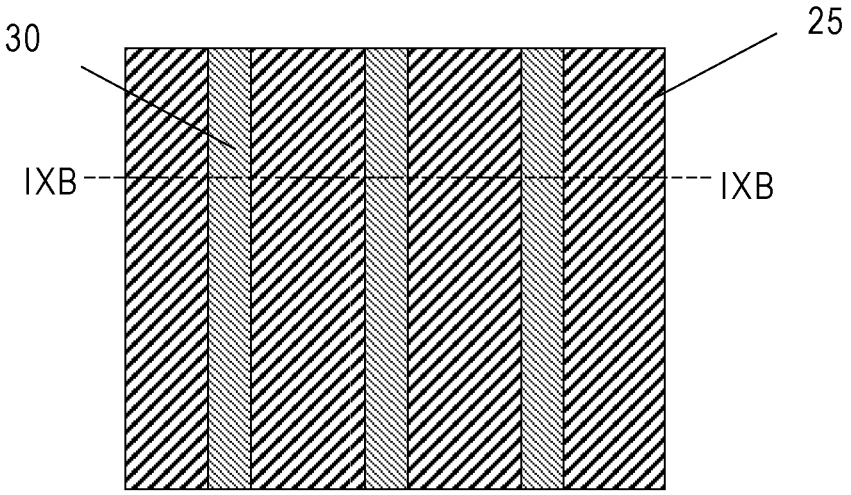
FIG. 9A is a top view of a sheet resistor body obtained by configuring metal in a plate shape in a second manufacturing method.
Figure 9B:
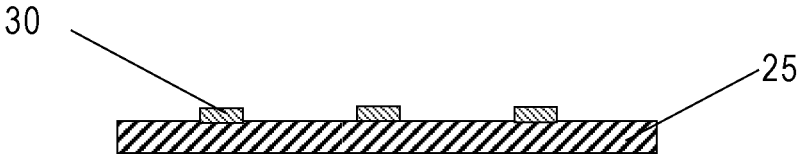
FIG. 9B is a sectional view taken along line IX B-IX B of the sheet resistor body of FIG. 9A.

First, as illustrated in FIGS. 9A and 9B, sheet resistor body 25 is prepared. Sheet resistor body 25 has one surface and another surface that are spaced apart from each other in the thickness direction, and is obtained by configuring a metal including CuMnNi alloy or the like in a plate shape. On the one surface (an upper surface) of sheet resistor body 25, a plurality of internal electrode parts 30 are formed in a belt shape so as to be located at fixed intervals.

The plurality of internal electrode parts 30 are formed by being plated with Cu, and are also formed in a belt shape by using a photolithographic method.

Here, FIG. 9A is a top view of sheet resistor body 25 obtained by configuring metal in a plate shape. FIG. 9B is a sectional view taken along line IX B-IX B of sheet resistor body 25 of FIG. 9A.

Figure 10A:
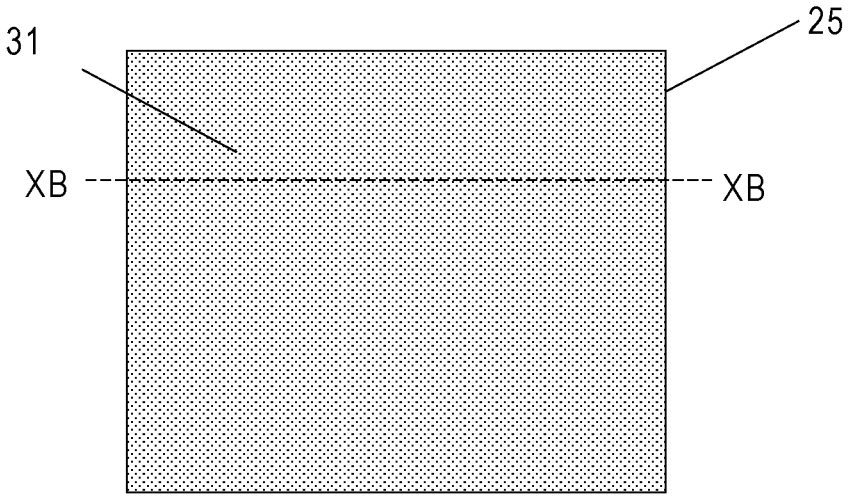
FIG. 10A is a top view of a sheet resistor body with a resin substrate stuck in the second manufacturing method.
Figure 10B:
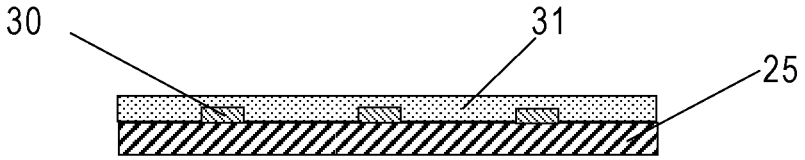
FIG. 10B is a sectional view taken along line X B-X B of the sheet resistor body of FIG. 10A.

Next, as illustrated in FIGS. 10A and 10B, resin substrate 31 is stuck so as to cover an upper surface of sheet resistor body 25 and the plurality of internal electrode parts 30. The plurality of internal electrode parts 30 are not exposed to an outside due to resin substrate 31. Resin substrate 31 is a substrate that includes epoxy resin and glass and that has a high strength, and resin substrate 31 includes the same material as a material of mounting substrate 21.

Here, FIG. 10A is a top view of sheet resistor body 25 with resin substrate 31 stuck. FIG. 10B is a sectional view taken along line X B-X B of sheet resistor body 25 of FIG. 10A.

Figure 10C:
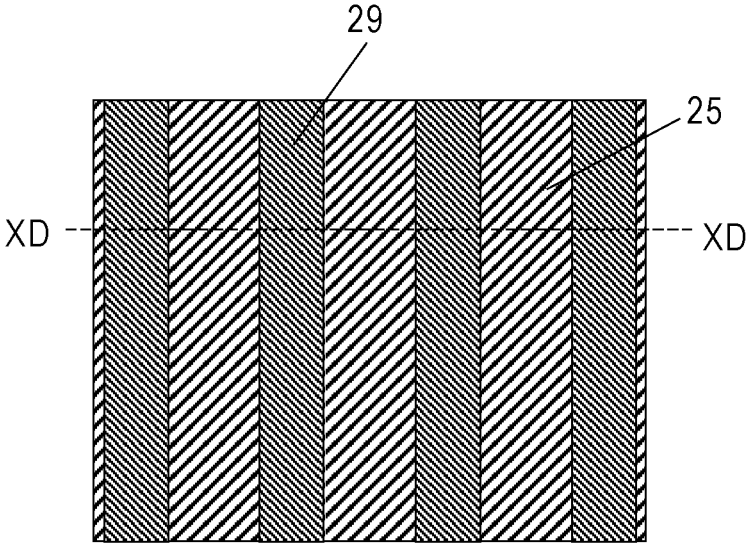
FIG. 10C is a bottom view of a sheet resistor body in which a plurality of electrode parts have been formed in a belt shape in the second manufacturing method.
Figure 10D:
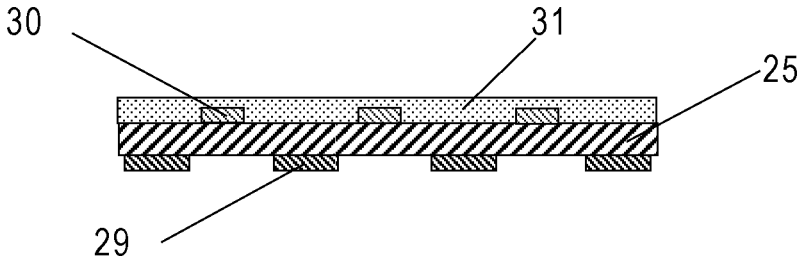
FIG. 10D is a sectional view taken along line X D-X D of the sheet resistor body of FIG. 10C.

Next, as illustrated in FIGS. 10C and 10D, a plurality of electrode parts 29 are formed in a belt shape on another surface of sheet resistor body 25 (a lower surface, namely, a surface on a side reverse to a surface on which resin substrate 31 has been stuck of sheet resistor body 25) so as to be located at fixed intervals. The plurality of electrode parts 29 described above are provided almost in parallel to the plurality of internal electrode parts 30, but the plurality of electrode parts 29 do not overlap the plurality of internal electrode parts 30 in a plan view. In addition, electrode part 29 is located in a middle part between adjacent internal electrode parts 30. Here, the plan view refers to a view from the upper surface of sheet resistor body 25.

Here, FIG. 10C is a bottom view (a view from a side of the electrode parts 29) of sheet resistor body 25 in which the plurality of electrode parts 29 have been formed in a belt shape. FIG. 10D is a sectional view taken along line X D-X D of sheet resistor body 25 of FIG. 10C.

In a metal plate resistor in the form of an individual piece, electrode parts 29 serve as a pair of electrodes 12*a*, 12*b*, internal electrode part 30 serves as internal electrode 14, and resin substrate 31 serves as second protection film 16.

Figure 11A:
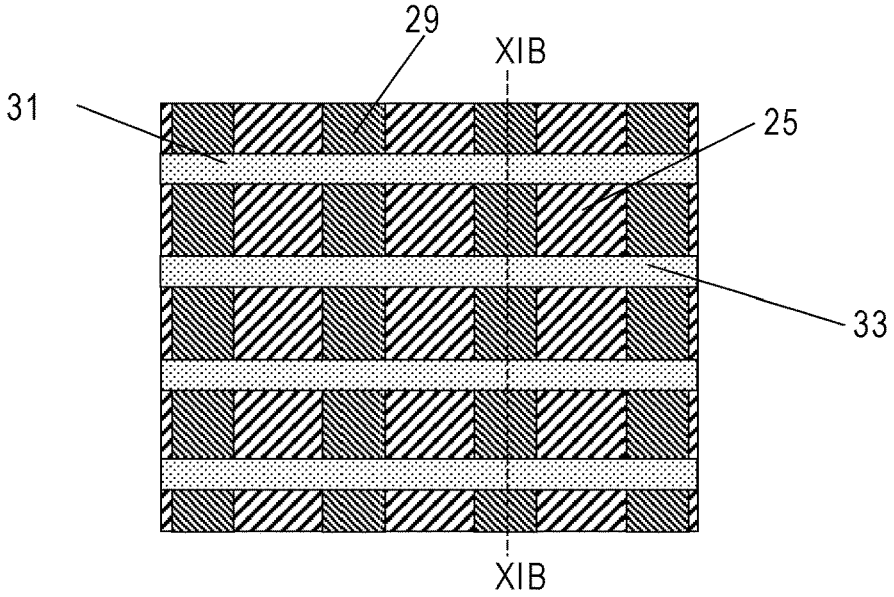
FIG. 11A is a bottom view of a sheet resistor body at a time when a plurality of grooves have been formed in a belt shape in the second manufacturing method.
Figure 11B:
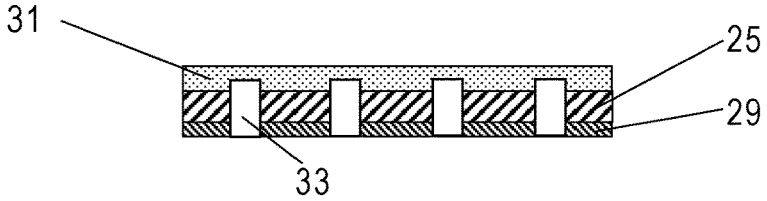
FIG. 11B is a sectional view taken along line XI B-XI B of the sheet resistor body of FIG. 11A.

Next, as illustrated in FIGS. 11A and 11B, a plurality of grooves 33 are formed in a belt shape on the lower surface of sheet resistor body 25 so as to be orthogonal to the plurality of internal electrode parts 30 and the plurality of electrode parts 29 in the plan view.

The plurality of grooves 33 completely pierce center parts of sheet resistor body 25 and the plurality of electrode parts 29, but the plurality of grooves 33 are only formed up to a midway part of resin substrate 31 (the plurality of grooves 33 do not completely pierce resin substrate 31). The plurality of grooves 33 are formed by dicing. By doing this, dimensional precision in a direction of a side surface of the metal plate resistor can be improved.

Here, FIG. 11A is a bottom view of sheet resistor body 25 at a time when the plurality of grooves 33 have been formed in a belt shape. FIG. 11B is a sectional view taken along line XI B-XI B of sheet resistor body 25 of FIG. 11A.

Thereafter, a slit may be formed as needed, and a resistance value may be adjusted.

Figure 11C:
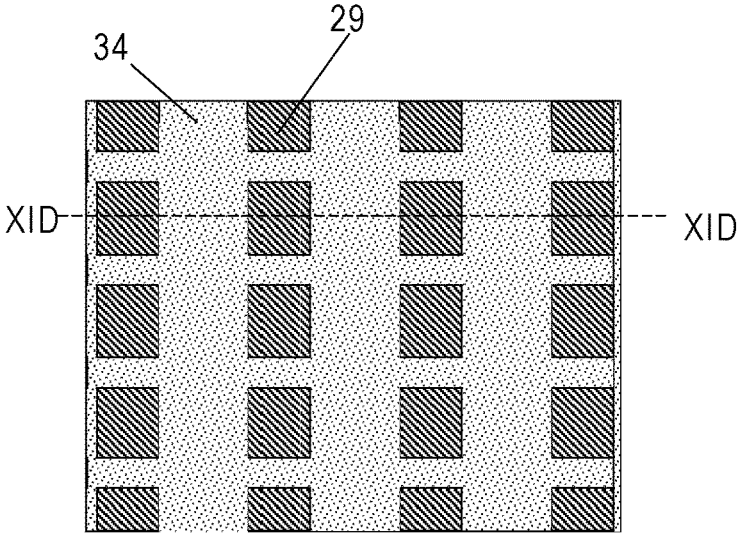
FIG. 11C is a bottom view of a sheet resistor body at a time when a protection film has been formed in the second manufacturing method.
Figure 11D:
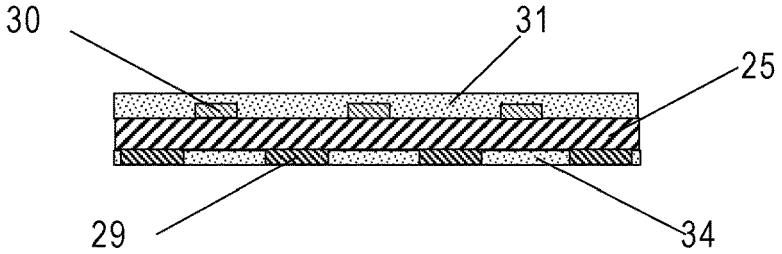
FIG. 11D is a sectional view taken along line XI D-XI D of the sheet resistor body of FIG. 11C.

Next, as illustrated in FIGS. 11C and 11D, protection film 34 is formed so as to completely cover the lower surface of sheet resistor body 25 and the plurality of electrode parts 29. In addition, protection film 34 includes epoxy resin, and an inside of each of the plurality of grooves 33 is also filled with protection film 34. Then, protection film 34 is hardened, and protection film 34 is polished until the plurality of electrode parts 29 are exposed.

Protection film 34 serves as first protection film 13 of a metal plate resistor in the form of an individual piece and a third protection film on side surfaces of the metal plate resistor. First protection film 13 and the third protection film are integrally formed.

Here, FIG. 11C is a bottom view of sheet resistor body 25 at a time when protection film 34 has been formed. FIG. 11D is a sectional view taken along line XI D-XI D of sheet resistor body 25 of FIG. 11C.

Figure 12A:
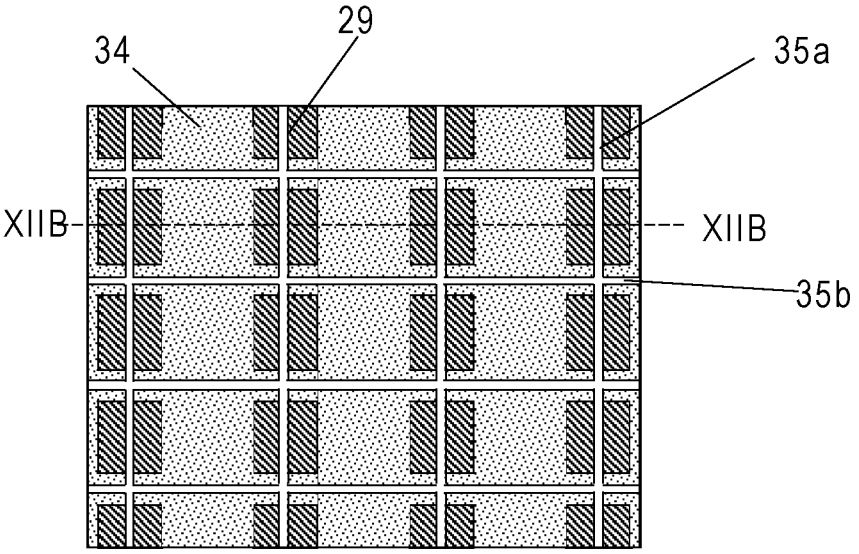
FIG. 12A is a bottom view of sheet resistor body immediately after cutting in center parts of the grooves in the second manufacturing method.
Figure 12B:
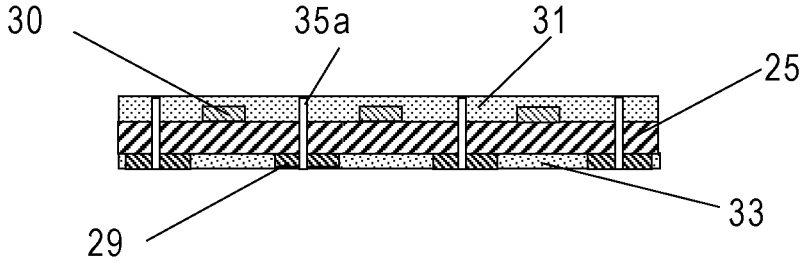
FIG. 12B is a sectional view taken along line XII B-XII B of the sheet resistor body of FIG. 12A.

Next, as illustrated in FIGS. 12A and 12B, sheet resistor body 25 is cut in middle parts 35*a* of the plurality of electrode parts 29 and center parts 35*b* of grooves 33 so as to be divided into individual pieces.

Here, FIG. 12A is a bottom view of sheet resistor body 25 immediately after cutting in middle parts 35*a* of the plurality of electrode parts 29 and center parts 35*b* of grooves 33. FIG. 12B is a sectional view taken along line XII B-XII B of sheet resistor body 25 of FIG. 12A.

Finally, Ni plating and Sn plating is performed from upper surfaces of a pair of electrodes 12*a*, 12*b* (electrode parts 29) to end surfaces of resistor body 11 in each of the metal plate resistors obtained by performing division into individual pieces, and plating layers 15 are formed.

(Third Manufacturing Method)

In addition, a method for manufacturing a metal plate resistor according to one exemplary embodiment may be formed according to the method described below. A method for manufacturing a metal plate resistor according to the present disclosure (a third manufacturing method) is described with reference to FIGS. 13A to 15D.

Figure 13A:
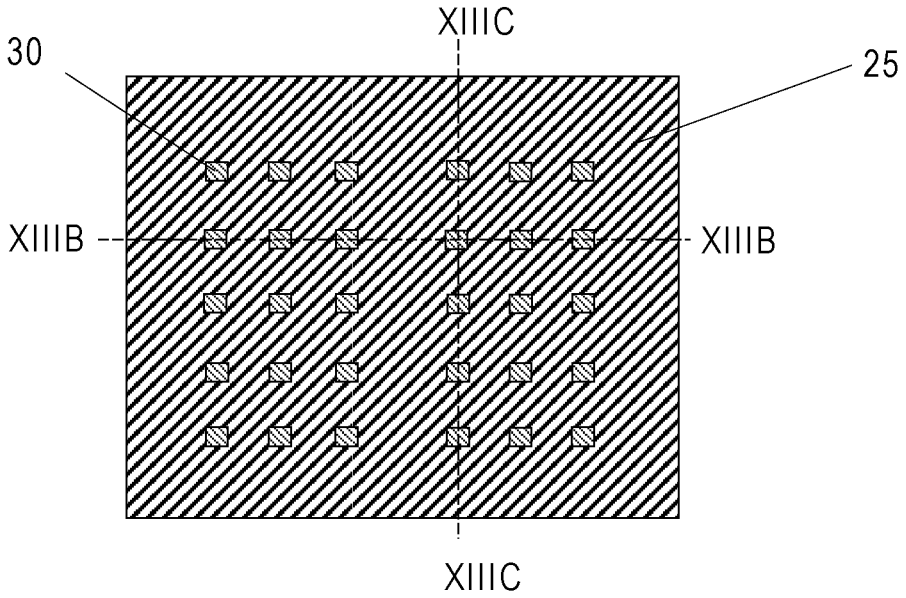
FIG. 13A is a top view of a sheet resistor body at a time when a plurality of internal electrode parts have been formed on an upper surface of the sheet resistor body so as to be disposed at fixed intervals in a horizontal direction and a vertical direction and a plurality of electrode parts have been formed on a lower surface of the sheet resistor body so as to be disposed at fixed intervals in the horizontal direction and the vertical direction in a third manufacturing method.
Figure 13B:
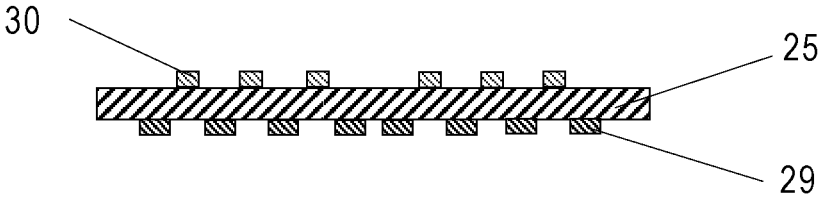
FIG. 13B is a sectional view taken along line XIII B-XIII B of the sheet resistor body of FIG. 13A.
Figure 13C:
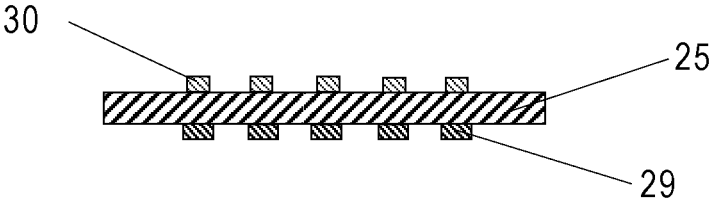
FIG. 13C is a sectional view taken along line XIII C-XIII C of the sheet resistor body of FIG. 13A.

First, as illustrated in FIGS. 13A, 13B, and 13C, sheet resistor body 25 is prepared. Sheet resistor body 25 has one surface and another surface that are spaced apart from each other in the thickness direction, and is obtained by configuring a metal including CuMnNi alloy or the like in a plate shape. On the one surface (an upper surface) of sheet resistor body 25, a plurality of internal electrode parts 30 are formed that are disposed at fixed intervals in a horizontal direction and a vertical direction. On the other surface (a lower surface) of sheet resistor body 25, a plurality of electrode parts 29 are formed that are disposed at fixed intervals in the horizontal direction and the vertical direction.

At this time, the plurality of internal electrode parts 30 and the plurality of electrode parts 29 are configured so as not to overlap each other in a plan view and to be disposed in one line when viewed from the horizontal direction, as illustrated in FIG. 13C.

The plurality of internal electrode parts 30 and the plurality of electrode parts 29 are formed by being plated with Cu, and are also formed in an island shape by using a photolithographic method.

In a metal plate resistor in the form of an individual piece, electrode parts 29 serve as a pair of electrodes 12*a*, 12*b*, and internal electrode part 30 serves as internal electrode 14.

Here, FIG. 13A is a top view of sheet resistor body 25 at a time when the plurality of internal electrode parts 30 have been formed on the one surface (the upper surface) of sheet resistor body 25 so as to be disposed at fixed intervals in the horizontal direction and the vertical direction and the plurality of electrode parts 29 have been formed on the other surface (the lower surface) of sheet resistor body 25 so as to be disposed at fixed intervals in the horizontal direction and the vertical direction. In addition, FIG. 13B is a sectional view taken along line XIII B-XIII B of sheet resistor body 25 of FIG. 13A. FIG. 13C is a sectional view taken along line XIII C-XIII C of sheet resistor body 25 of FIG. 13A.

Figure 14A:
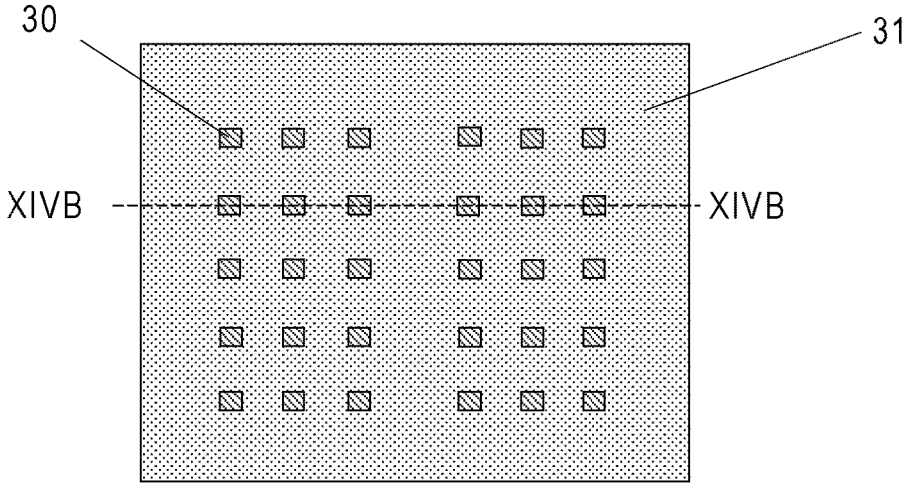
FIG. 14A is a top view of a sheet resistor body at a time when a first protection member has been formed in the third manufacturing method.
Figure 14B:
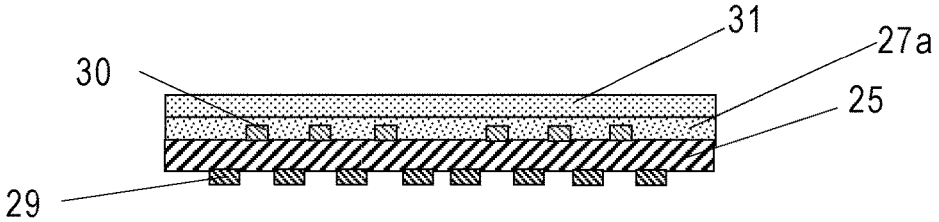
FIG. 14B is a sectional view taken along line XIV B-XIV B of the sheet resistor body of FIG. 14A.

Next, as illustrated in FIGS. 14A and 14B, first protection member (protection film) 27*a* is formed so as to cover the upper surface of sheet resistor body 25 and the plurality of internal electrode parts 30. Then, first protection member 27*a* is hardened. Further, resin substrate (protection film) 31 is stuck so as to cover first protection member 27*a*.

First protection member 27*a* is a film including epoxy resin, and a member that increases fluidity by vacuum hot pressing is used. First protection member 27*a* serves as second protection film 16 in a metal plate resistor in the form of an individual piece. Resin substrate 31 is a substrate that includes epoxy resin and glass and that has a high strength, and resin substrate 31 includes the same material as a material of mounting substrate 21.

Here, FIG. 14A is a top view of sheet resistor body 25 at a time when first protection member 27*a* has been formed. FIG. 14B is a sectional view taken along line XIV B-XIV B of sheet resistor body 25 of FIG. 14A.

Figure 14C:
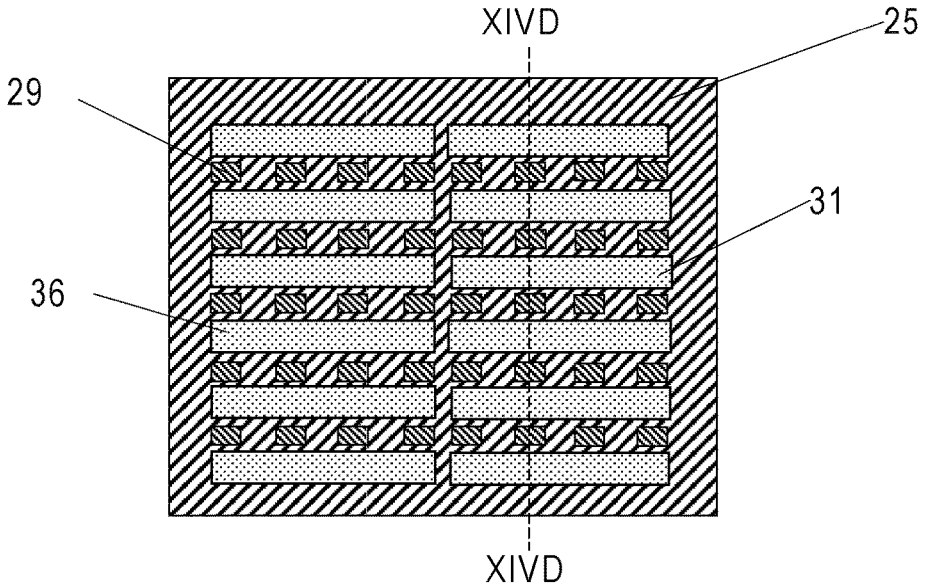
FIG. 14C is a bottom view of sheet resistor body viewed from a side of a plurality of electrode parts at a time when the plurality of electrode parts and a plurality of grooves have been formed in the third manufacturing method.
Figure 14D:
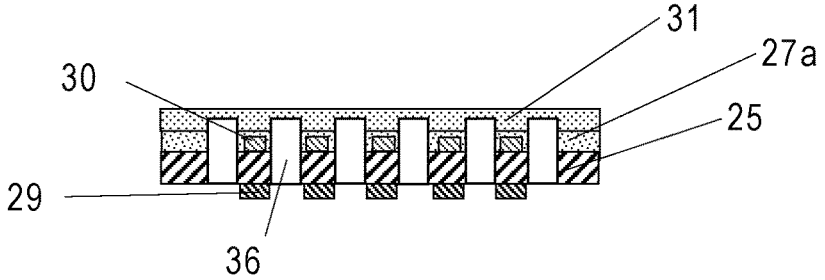
FIG. 14D is a sectional view taken along line XIV D-XIV D of the sheet resistor body of FIG. 14C.

Next, as illustrated in FIGS. 14C and 14D, groove 36 is formed in each space between a plurality of electrode parts 29 that are disposed in one line when viewed from the horizontal direction and an adjacent plurality of electrode parts 29 that are disposed in one line.

Grooves 36 completely pierce sheet resistor body 25 and first protection member 27*a*, but grooves 36 are only formed up to a midway part of resin substrate 31 (grooves 36 do not completely pierce resin substrate 31). Grooves 36 are formed by dicing. By doing this, dimensional precision in a direction of a side surface of the metal plate resistor can be improved.

Here, FIG. 14C is a bottom view of sheet resistor body 25 viewed from a side of the plurality of electrode parts 29 at a time when the plurality of electrode parts 29 and grooves 36 have been formed. FIG. 14D is a sectional view taken along line XIV D-XIV D of sheet resistor body 25 of FIG. 14C.

Thereafter, a slit may be formed as needed, and a resistance value may be adjusted.

Figure 15A:
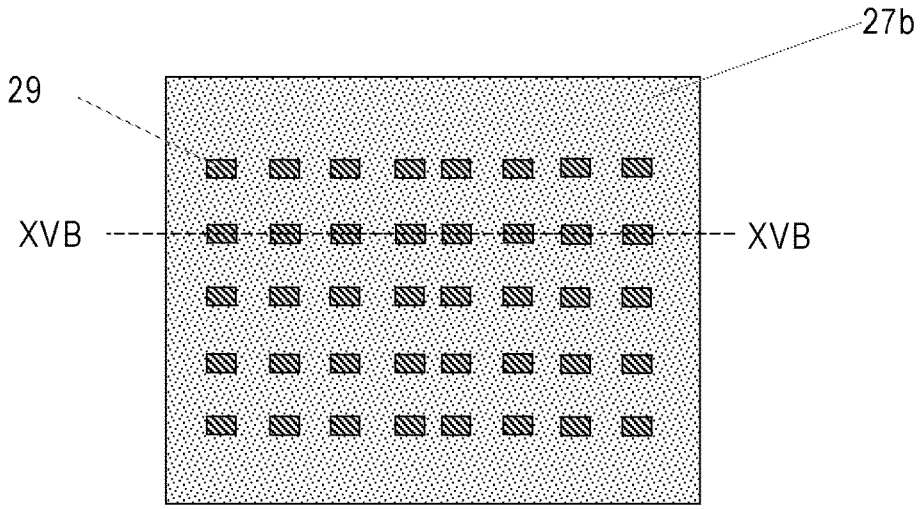
FIG. 15A is a bottom view of a sheet resistor body at a time when a second protection member has been formed in the third manufacturing method.
Figure 15B:
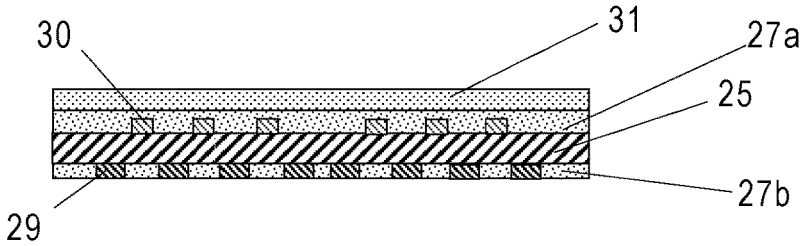
FIG. 15B is a sectional view taken along line XV B-XV B of the sheet resistor body of FIG. 15A.

Next, as illustrated in FIGS. 15A and 15B, second protection member (another protection film) 27*b* is formed so as to cover the lower surface of sheet resistor body 25 and the plurality of electrode parts 29.

In addition, second protection member 27*b* is a film including epoxy resin, and a member that increases fluidity by vacuum hot pressing is used. An inside of each of grooves 36 is also filled with second protection member 27*b*. Then, second protection member 27*b* is hardened, and second protection member 27*b* is polished until the plurality of electrode parts 29 are exposed.

Second protection member 27*b* serves as first protection film 13 of a metal plate resistor in the form of an individual piece and a third protection film on side surfaces of the metal plate resistor. First protection film 13 and the third protection film are integrally formed.

Here, FIG. 15A is a bottom view of sheet resistor body 25 at a time when second protection member (the other protection film) 27*b* has been formed. FIG. 15B is a sectional view taken along line XV B-XV B of FIG. 15A.

Figure 15C:
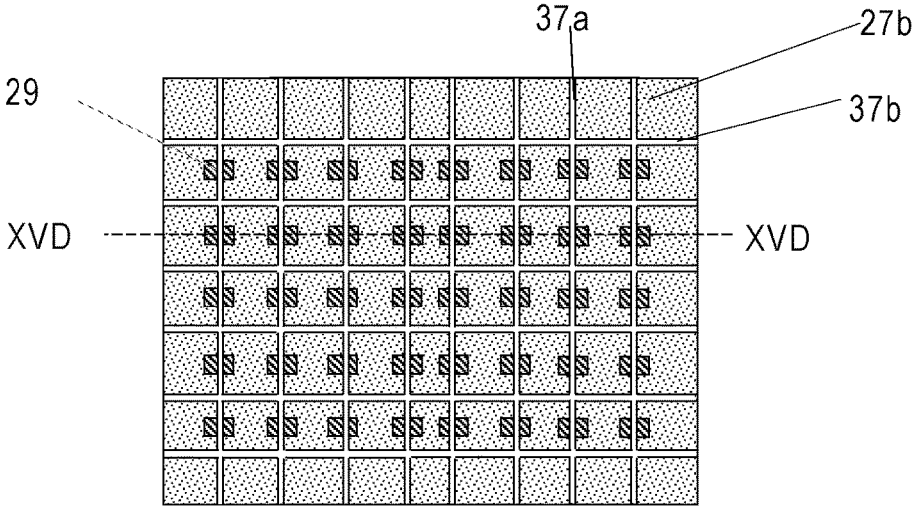
FIG. 15C is a bottom view of a sheet resistor body immediately after division into a plurality of individual pieces in the third manufacturing method.
Figure 15D:
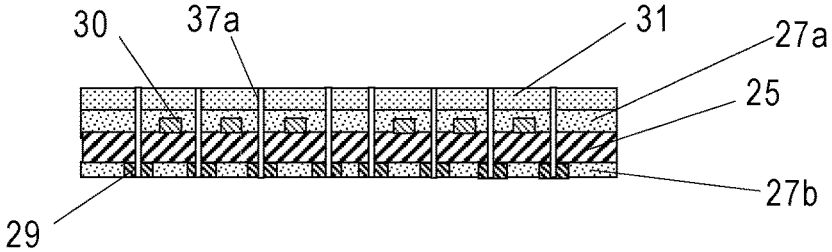
FIG. 15D is a sectional view taken along line XV D-XV D of the sheet resistor body of FIG. 15C.
Figure 16:
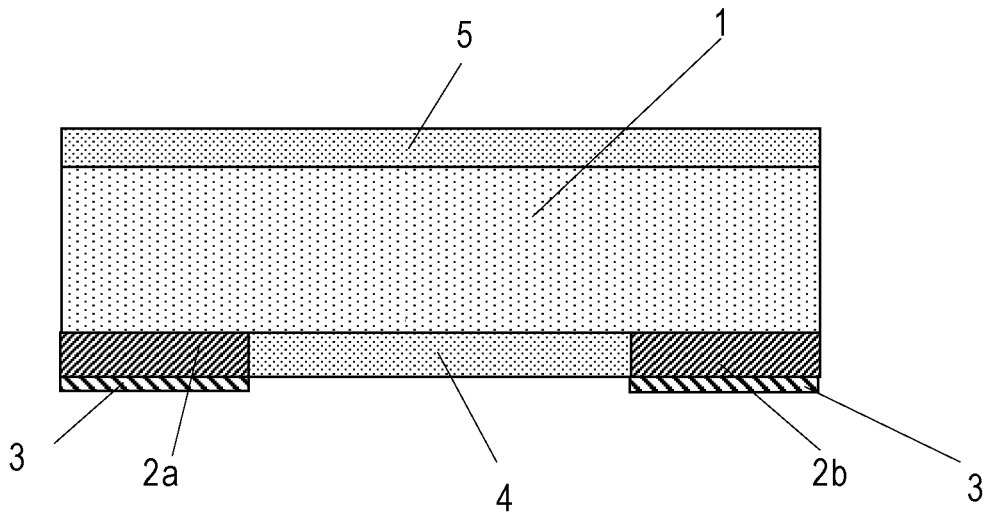
FIG. 16 is a sectional view of a conventional metal plate resistor.

Next, as illustrated in FIGS. 15C and 15D, sheet resistor body 25 is cut in middle parts 37*a* of the plurality of electrode parts 29 and center parts 37*b* of grooves 36 so as to be divided into a plurality of individual pieces.

Here, FIG. 15C is a bottom view of sheet resistor body 25 immediately after division into a plurality of individual pieces. FIG. 15D is a sectional view taken along line XV D-XV D of sheet resistor body 25 of FIG. 15C.

Finally, Ni plating and Sn plating is performed from upper surfaces of a pair of electrodes 12*a*, 12*b* (electrode parts 29) to end surfaces of resistor body 11 in each of the metal plate resistors obtained by performing division into individual pieces, and plating layers 15 are formed.

A metal plate resistor according to the present disclosure exhibits an effect of being capable of reducing a resistance value and a TCR, and is useful as a metal plate resistor or the like that is used for the purpose of detection of a current of information communication equipment represented by smartphones or tablets.

The invention claimed is:

1. A metal plate resistor comprising:

a resistor body that includes a metal plate including an upper surface and a lower surface that are spaced apart from each other in a thickness direction;

a pair of electrodes that include a metal having an electrical resistivity lower than an electrical resistivity of the resistor body and the metal having a thermal coefficient of resistance higher than a thermal coefficient of resistance of the resistor body in comparison with the resistor body, the pair of electrodes being formed in both ends of the lower surface of the resistor body; and an internal electrode that is formed on the upper surface of the resistor body, wherein the internal electrode includes a metal having an electrical resistivity lower than the electrical resistivity of the resistor body, and wherein a length of the internal electrode is less than or equal to a length between the pair of electrodes, and the internal electrode does not overlap the pair of electrodes in a top view.

2. The metal plate resistor according to claim 1, wherein a thickness of the resistor body is 0.4 times or more a length between the pair of electrodes.

3. The metal plate resistor according to claim 1, wherein the pair of electrodes are also formed on end surfaces of the resistor body.

4. The metal plate resistor according to claim 1, wherein a land is formed on lower surfaces of the pair of electrodes, and a voltage is measured in positions that face each other in a longitudinal direction of a plurality of the lands.

5. The metal plate resistor according to claim 1, wherein a slit is formed on the lower surface of the resistor body between the pair of electrodes.

6. A method for manufacturing a metal plate resistor, the method comprising:

forming a plurality of cutouts in a sheet resistor body that includes one surface and another surface that are spaced apart from each other in a thickness direction, the plurality of cutouts piercing the sheet resistor body;

integrally forming a protection member on the one surface of the sheet resistor body and inside the plurality of cutouts;

forming a plurality of holes in the protection member in portions where the plurality of cutouts have not been formed on the one surface of the sheet resistor body;

forming an internal electrode part in the plurality of holes, and forming a plurality of electrode parts at equal intervals in portions where the plurality of cutouts have not been formed on the other surface of the sheet resistor body;

forming a resin substrate in the protection member and the internal electrode part;

forming a protection film between the plurality of electrode parts on the other surface of the sheet resistor body; and cutting middle parts of the plurality of cutouts and the plurality of electrode parts and performing division into individual pieces.

7. A method for manufacturing a metal plate resistor, the method comprising:

forming a plurality of internal electrode parts on one surface of a sheet resistor body that includes the one surface and another surface that are spaced apart from each other in a thickness direction, the plurality of internal electrode parts being located at fixed intervals;

forming a resin substrate that covers the one surface of the sheet resistor body and the plurality of internal electrode parts;

forming a plurality of electrode parts that are located at fixed intervals on the other surface of the sheet resistor body and that do not overlap the plurality of internal electrode parts in a plan view;

forming a plurality of grooves on the other surface of the sheet resistor body, the plurality of grooves crossing the plurality of internal electrode parts and the plurality of electrode parts in the plan view;

forming a protection film that covers the other surface of the sheet resistor body and the plurality of electrode parts;

polishing the protection film until the plurality of electrode parts are exposed; and dividing the sheet resistor body in middle parts of the plurality of electrode parts and center parts of the plurality of grooves, wherein the plurality of grooves pierce the sheet resistor body and the plurality of electrode parts, and reach a midway part of the resin substrate.

8. A method for manufacturing a metal plate resistor, the method comprising:

forming a plurality of internal electrode parts on one surface of a sheet resistor body that includes the one surface and another surface that are spaced apart from each other in a thickness direction, the plurality of internal electrode parts being disposed at fixed intervals in a horizontal direction and a vertical direction, and forming a plurality of electrode parts on the other surface of the sheet resistor body, the plurality of electrode parts being disposed at fixed intervals in the horizontal direction and the vertical direction, the plurality of internal electrode parts not overlapping the plurality of electrode parts in a plan view, the plurality of internal electrode parts and the plurality of electrode parts being disposed in an identical direction of the horizontal direction;

forming a protection film that covers the one surface of the sheet resistor body and the plurality of internal electrode parts;

forming a groove between each pair of the pluralities of electrode parts that are disposed in the horizontal direction in the sheet resistor body;

forming another protection film that covers the other surface of the sheet resistor body and the plurality of electrode parts, and polishing the other protection film until the plurality of electrode parts are exposed; and dividing the sheet resistor body in middle parts of the plurality of electrode parts and center parts of a plurality of the grooves, wherein the groove pierces the sheet resistor body, and reaches a midway part of the protection film.

* * * * *